United States Patent [19]

Kesten et al.

[11] 4,143,597

[45] Mar. 13, 1979

[54] RESILIENT PLATE CLAMPING MEANS

[75] Inventors: Martin Kesten, West Hartford; Frank W. Tevald, Enfield, both of Conn.

[73] Assignee: Preston Engravers, Inc., Windsor, Conn.

[21] Appl. No.: 791,474

[22] Filed: Apr. 27, 1977

[51] Int. Cl.[2] ..... B41F 27/06; B41F 27/10

[52] U.S. Cl. ..... 101/378; 101/383; 101/384

[58] Field of Search ..... 101/378, 381, 382 R, 101/383–389, 415.1; 24/108, 217; 29/110, 124, 125, 129

[56] References Cited

U.S. PATENT DOCUMENTS

| | | | |
|---|---|---|---|
| 1,031,661 | 7/1912 | Osborn | 101/386 X |
| 1,344,648 | 6/1920 | Nordfors | 101/378 |
| 1,597,534 | 8/1926 | Meyer | 101/384 |
| 1,648,598 | 11/1927 | Smith | 101/378 |
| 2,364,266 | 12/1944 | Bryce | 24/217 W X |

*Primary Examiner*—Ronald E. Suter

[57] ABSTRACT

A plurality of circumferentially extending mounting recesses are formed in a cylinder assembly and arcuate saddle members having marking means, such as print type, on their outside surface are mounted in the recesses. Each saddle member has a locking recess formed in its inside surface with a pair of spaced apart, flexible locking wires extending therethrough. Mounting studs having a mounting head with a relatively narrow neck portion are affixed to the cylinder within the mounting recesses. The saddle members may be mounted within the mounting recesses by snap-on engagement of the mounting head with the locking wires, and readily removed by snap-off disengagement of the head with the wires. The saddle members may thus be readily replaced and interchanged by means of the snap-on, snap-off mounting and demounting.

18 Claims, 7 Drawing Figures

RESILIENT PLATE CLAMPING MEANS

BACKGROUND OF THE INVENTION

The present invention relates to cylinders employed on a press as part of the press assembly for printing, embossing, punching or otherwise marking web or sheet material fed through the press. The invention has particular application to printing cylinders, although it is not limited thereto. In general, the invention pertains to press cylinders of the type having removable printing plates mounted to a support cylinder.

A known type of printing plate is made of a thin flexible material which is adhesively mounted on a printing cylinder. When it is desired to change a portion of the print type it is necessary to remove the flexible printing plate, or selected portions thereof, and replace it with the new printing plate material. To accomplish this, many known printing cylinders require removal of the printing plate or sections, realignment of the new sections of the plate on the cylinder, and re-adhesion onto the cylinder. The process is time consuming and often results in inadvertent damaging of the printing plate or portions of it.

In general, the prior art discloses the concept of providing a flexible printing plate attached to a printing cylinder. Such prior art devices usually involve a thin, flexible plate to which is affixed, on the underside thereof, locking bars or wedges adapted to be received within a groove or otherwise attached to means provided on the cylinder. Such devices usually involve rather complex plate locking members and cylinder fastening and aligning devices. The plates are of course subjected to considerable centrifugal forces by rotation of the press cylinder and to other stresses during printing, and so must be securely mounted.

For example, U.S. Pat. Nos. 1,503,074; 3,152,544; and 3,603,256 each show different mounting means for mounting printing plates to a cylinder form. Each of these prior patents shows fairly complex securing means which are relatively expensive to manufacture and possibly not feasible in relatively small cylinders, such as on presses used to print labels, etc.

It is an object of the present invention to overcome the problems and shortcomings of prior art devices and to provide a novel press cylinder or assembly including simple and efficient means for removably mounting saddle members to a support cylinder.

It is another object of the present invention to provide a simple snap-on, snap-off type mounting which removably yet securely affixes saddle members carrying print type or other marking means to a support cylinder.

It is yet another object of the present invention to provide a press cylinder assembly in which a selected one or more of such saddle members may be removed and replaced on a support cylinder to permit replacement of selected portions of a printing or other marking cylinder.

SUMMARY OF THE INVENTION

In accordance with the present invention there is provided a press cylinder assembly which comprises a support cylinder which has at least one circumferentially extending mounting recess formed in it to define a recessed mounting surface. At least one arcuate saddle member has an inside surface and is removably mounted on the support cylinder within the mounting recess. At least one mounting stud and at least one locking recess are provided, one of which is situated on the mounting surface of the support cylinder and the other of which is situated on the inside surface of the saddle member, the mounting stud being affixed at one end to the member providing the surface on which it is situated. The mounting stud has a mounting head on its other end and a neck portion of lesser width than width of the mounting head, the neck portion being formed between the mounting head and the aforesaid one end of the stud. The locking recess extends into the member providing the surface on which the locking recess is situated. A plurality of resiliently deflectable locking members are mounted on the member providing the surface on which the locking recess is situated, the locking members extending in spaced relationship within the locking recess. The stud projects into the locking recess with the mounting head disposed in the locking recess inwardly of and between the locking members, the locking members being spaced apart a distance less than the width of the mounting head and being aligned with the neck portion on opposite sides thereof to resiliently lock the stud therebetween and thereby maintain the saddle member on the support cylinder.

In accordance with one aspect of the invention, the mounting stud is affixed at its one end to the support cylinder in the mounting recess, and the locking recess is formed in the inside surface of the saddle member, the plurality of resiliently deflectable locking members being mounted on the saddle member.

Certain objects of the invention are attained when the circumferentially extending mounting recesses have side walls and a convex floor surface, a mounting head and neck portion of the mounting stud project outwardly of the convex floor surface, and the saddle member has a concave inside surface which is substantially congruent to and seated upon the convex floor surface. The arcuate saddle member further has side edges which abut the side walls of the mounting recess. The saddle member also has an outside surface on which marking means are supported. The marking means may comprise print type, embossing means or the like.

Certain objects of the invention are attained when the locking members extend in spaced relationship within the locking recess, and comprise a pair of flexible, resilient steel wires and the mounting head is of generally spherical configuration. Other objects of the invention are attained when the support cylinder contains a plurality of mounting recesses, and a plurality of saddle members are mounted within said recesses and the outside surfaces of said saddle members are substantially flush with the outer surface of the support cylinder.

DESCRIPTION OF THE PREFERRED EMBODIMENTS

Figure 1:
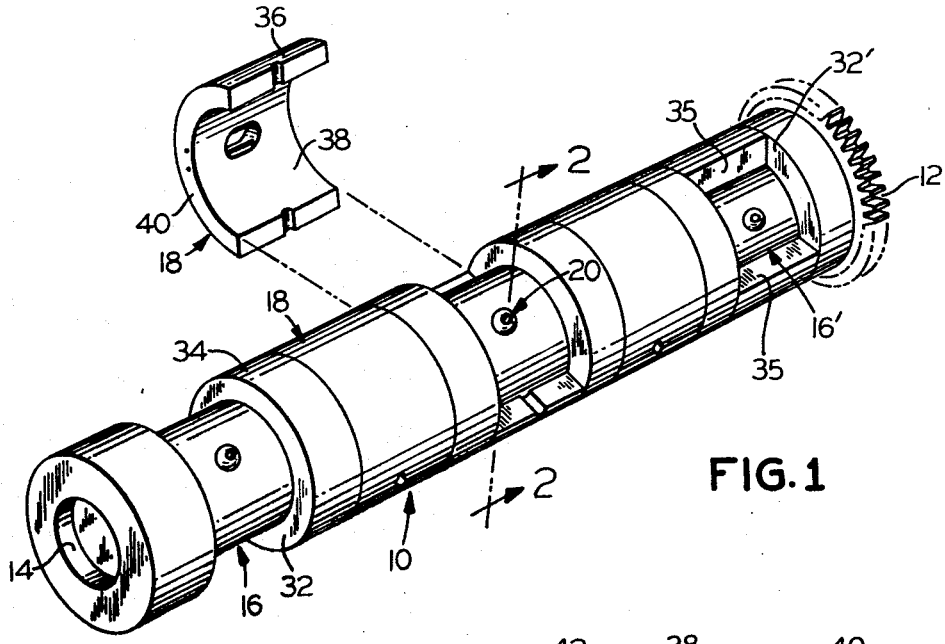
FIG. 1 is a perspective view of one embodiment of a press cylinder assembly of the invention with parts removed therefrom.

Referring now to FIG. 1, a printing cylinder assembly is generally indicated at 10 and has a drive gear 12 affixed at one end thereof and a journal hub opening 14 formed at the opposite end thereof for journaling and driving of the cylinder in a press in the known manner. A plurality of mounting recesses, a typical one of which is indicated at 16, are formed along the length of cylinder 10. Mounting recess 16' is of somewhat different configuration, as described below. Mounting recesses 16 each comprise a longitudinally extending (with respect to cylinder 10) reduced diameter portion of cylinder 10 which defines a circumferentially extending convex mounting recess floor 30. Side walls 32 (FIG. 2) extend transversely between floor 30 and the outer surface 34 of cylinder 10. Outer surface 34 is divided by recesses 16 into a plurality of lands disposed between adjacent mounting recesses. In the embodiment illustrated in the drawings, mounting recesses 16 extend circumferentially about the entire circumference of cylinder 10. In an alternate construction, the mounting recess extends circumferentially about only a portion, but less than all, of the circumference of cylinder 10, as is illustrated by mounting recess 16' which subtends an arc segment of the circumference of cylinder 10. This type of structure would find particular use in larger diameter cylinders. In addition to side walls 32', mounting recess 16' defines a pair of end walls 35. As with mounting recesses 16, a mounting stud is disposed within mounting recess 16'. In practice, all the mounting recesses of a given cylinder are preferably, although not necessarily, identically configured. In FIG. 1 of the drawings, both full circumferential recesses 16 and a segment circumferential recess 16' are shown for purposes of illustration.

Each mounting recess 16 thus essentially comprises a longitudinally extending (with respect to cylinder 10) reduced diameter cylindrical segment of cylinder 10 and is adapted to receive therein, in the embodiment illustrated, two arcuately shaped saddle members 18, each saddle member occupying one half of its associated mounting recess 16. Each mounting recess 16 is substantially filled by its two associated saddle members 18 so that with saddle members 18 mounted in place, cylinder 10 presents a cylindrical outer surface suitable for printing, embossing or the like.

Figure 3:
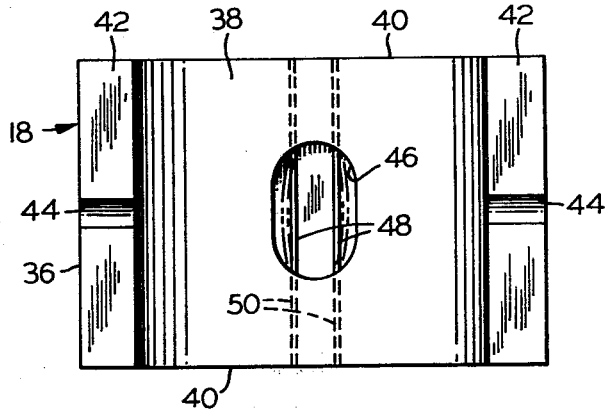
FIG. 3 is plan view of the inside of a typical one of the removed parts of FIG. 1, shown on a scale enlarged with respect to FIG. 1.

Referring now to FIG. 3, saddle member 18 is seen to comprise a semi-cylindrical, arcuately shaped wall segment having a convex outside surface 36, a concave inside surface 38, semi-circular edges 40, and ends 42. Semi-circular grooves 44 are formed, respectively, in the surfaces of end walls 42.

Figure 2:
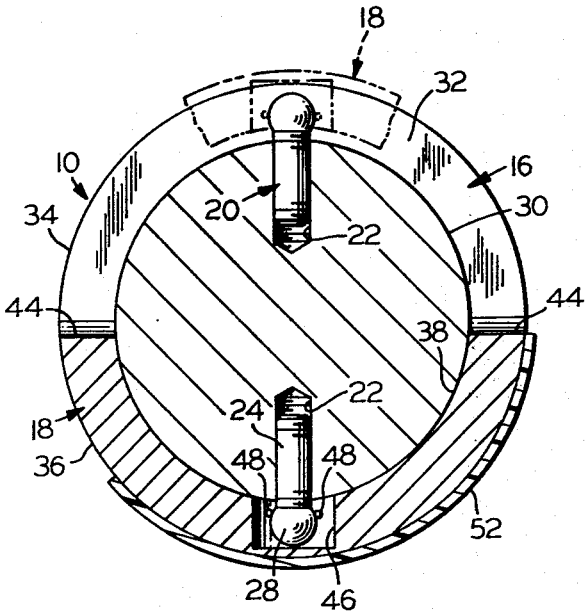
FIG. 2 is an enlarged section view in elevation taken along line II—II of FIG. 1.

A slot-shaped locking recess 46 is formed in inside surface 38 of saddle member 18 and, as best seen in FIG. 2, extends into the wall of saddle member, i.e., into the member providing the surface in which locking recess 46 is situated, to a depth sufficient to receive mounting head 28 and neck portion 26 of mounting stud 20 therein. Locking recess 46 does not, however, extend to outside surface 36 of saddle member 18.

A pair of opposed locking members 48 are mounted in saddle member 18 and extend through a pair of channels 50 (FIG. 3) drilled through the wall of saddle member 18. Locking members 48 comprise, in the embodiment shown, a pair of flexible, resilient relatively thick but deflectable steel wires or rods mounted on saddle member 18 and extending in spaced relationship within locking recess 46. Locking members 48 are secured within channels 50 in any suitable manner, by closing the ends of channels 50, or crimping the ends of locking members 48 to friction fit them within channels 50, etc.

Figure 4:
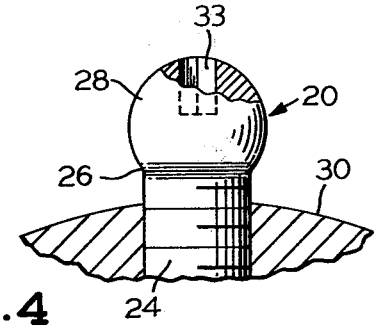
FIG. 4 is an enlarged fragmentary view, showing a portion of the mounting stud of FIGS. 1 and 2.

As best shown in FIG. 2, a pair of mounting studs 20 are affixed to support cylinder 10 by being threaded into respective threaded openings 22 located circumferentially opposite each other on cylinder 10, within mounting recesses 16. Mounting studs 20 include a shaft 24, a neck portion 26 and a mounting head 28. As best seen in FIG. 4, the juncture of mounting head 28 and shaft 24 provides the neck portion 26. Mounting head 28 is provided with a recess 33 to receive a tool such as an allen wrench to thread mounting stud 20 into threaded recess 22. Mounting studs 20 are affixed at one end thereof to cylinder 10 so that mounting head 28 and neck portion 26 project exteriorly of mounting recess floor 30 within mounting recess 16. Mounting head 28 is seen to be of larger width than neck portion 26.

Locking recess 46 is, in the embodiment illustrated, an elongated slot having sidewalls and a bottom wall (unnumbered). The slot is slightly wider and considerably longer than the maximum width or diameter of mounting head 28, and locking members 46 are parallel to each other and spaced apart a distance which is less than the maximum width of diameter of mounting head 20. The depth of locking recess 46 is sufficiently great to receive mounting head 28 and neck portion 26 fully therein. Locking members 48 extend across the opening of locking recess 46 in inside surface 38 of saddle 18 and are positioned sufficiently close thereto that in order for mounting stud 20 to project into recess 46 sufficiently to fully receive head 28 and neck portion 26 therein, locking members 48 must be passed by head 28 and be aligned with neck portion 26.

Saddle members 18 are removably mounted to support cylinder 10 simply by placing saddle member 18 in position adjacent a selected one of mounting recesses 16 so that locking recess 46 and locking member 48 are aligned with mounting head 28, and edges 40 of saddle member 18 are disposed in respective planes which are substantially parallel to side walls 32. Then, as illustrated in dotted outline in FIG. 2, as saddle member 18 is moved towards cylinder 10, locking members 48 contact the outermost portion of mounting head 28 and are deflected from their normal position and forced apart (to the position indicated by the dot-dash lines in FIG. 3) so that they pass over mounting head 28 on opposite sides thereof. As locking members 48 pass over mounting head 28 towards neck portion 46, their flexible resiliency biases them back into their normal, parallel position from the deflected position to which they were forced by the large width portion of head 28. As locking members 48 become aligned with neck portion 46 they resiliently engage neck portion 46 to mount saddle member 18 to support cylinder 10, with edges 40 in abutting contact with the corresponding segments of side walls 32, and inside surface 38 in contact with floor 30 of mounting recess 16. The holding force for a given set of locking members 48, can be adjusted by threading stud 20 further into or out of threaded opening 22. In the embodiment illustrated, two saddle members 18 disposed within a single mounting recess 16 substantially completely fill the same, with ends 42 of the opposed pair of saddle members 18 in abutting contact with each other.

Grooves 44 of the paired saddle members 18 face each other to provide a channel into which a tool member may be inserted and twisted to pry saddle members 18 off support cylinder 10 when it is desired to remove them. It is thus seen that a simple and efficient snap-on and snap-off mounting of saddle members 18 is provided which allows for securely yet removably mounting saddle members 18 to support cylinder 10.

Mounting recess 16', in the embodiment illustrated, would similarly be filled by a single saddle member, not shown, having edges corresponding to edges 40 of saddle members 18 placed in abutting contact with corresponding side walls 32', and further having ends corresponding to ends 42 of saddle members 18 placed in abutting contact with respective end walls 35.

Grooves corresponding to grooves 44 may be formed in the single saddle member to be received within recess 16' and/or similar grooves may be formed in end walls 35 of recess 16'. These grooves would be adapted to receive a tool member to be inserted to pry the saddle member outwardly of recess 16' to snap it off its mounting stud for removal.

Outside surfaces 36 of saddle members 18, or selected portions thereof, are provided with marking means, for example, printing type, embossing patterns or other devices to print, mark, emboss or otherwise alter a web or sheet of material by means of cylinder 10. For clarity of illustration such marking means are not shown in FIG. 1, but one type is illustrated in FIG. 2. In FIG. 2, there is shown in partially broken-away cross section a known type of flexible printing plate 52 which has suitable print characters formed on its outside surface. Such printing plates are well known in the art, and are generally glued or otherwise secured to the outside surfaces 36 of saddle members 18. Instead of a printing plate affixed to outside surface 36 of saddle members 18, print characters or other design patterns can be permanently engraved or etched on outside surfaces 36 of members 18. By means of the structure provided in accordance with the invention, saddle member 18 can be readily changed, replaced and interchanged to provide different markings without necessity of removing printing plate 52 from saddle members 18 or of regrinding or re-etching outside surfaces 36. One saddle member simply replaces another.

When it is desired to remove a saddle member 18 from cylinder 10, it is only necessary to insert a tool into the channel provided by juxtaposed grooves 44 and twist the tool to force the saddle members 18 away from cylinder 10. This causes locking members 48 to pass over mounting head 28, locking members 48 being deflected apart sufficiently to pass around mounting head 28 and then returning to their normal position.

Figure 6:
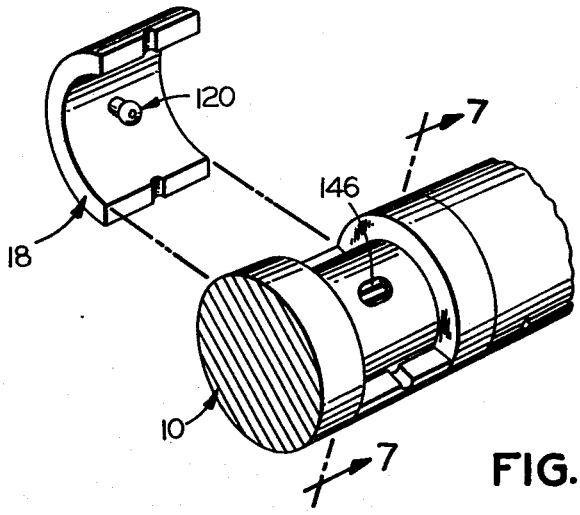
FIG. 6 is a fragmentary perspective view similar to FIG. 1 of an alternate embodiment wherein the disposition of the mounting studs and locking recesses is reversed.
Figure 7:
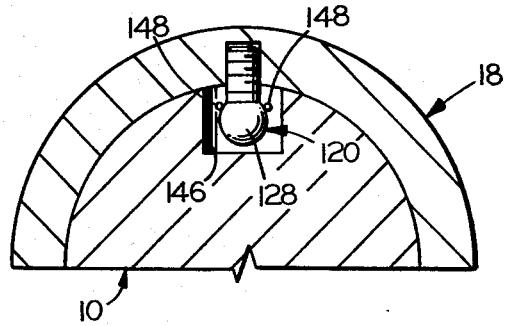
FIG. 7 is a fragmentary sectional view of the embodiment of FIG. 6 to an enlarged scale.

Turning now to the embodiment of FIGS. 6 and 7, therein illustrated is a structure in which the disposition of the mounting stud and locking recess is reversed. The mounting stud 120 is provided upon the saddle member 18 and the locking recess 146 is provided in the floor of the mounting recess 16. As best seen in FIG. 7, the mounting recess 146 has two locking members 148 extending thereacross to engage the head 128 of the stud 120 and thereby secure the saddle member 18 upon the cylinder 10.

In general, the flexible, resilient locking means may be of any suitable configuration which provides at least a pair of opposed members which provide a resiliently flexible action between them whereby they may be forced apart by a mounting head of a given width and tend to return to or towards their original position as the mounting head passes between and past them to resiliently engage a neck portion of lesser width than the mounting head.

While the preferred embodiments illustrated show a mounting stud affixed to the cylinder and the locking recess and locking members in the saddle member, this construction may obviously be reversed so that the locking recess is formed in the cylinder, in the mounting floor thereof, with the locking members mounted on the cylinder within the locking recess, and the studs affixed to the saddle members with the mounting head projecting outwardly of the inside surface thereof.

Although the saddle members illustrated have convex outside surfaces and concave inside surfaces, the inside surfaces need not necessarily be concave but could be generally flat, polygonal or convex, with the mounting floor of the mounting recess being shaped accordingly. Generally, the illustrated embodiment is preferred for manufacturing simplicity.

Provision of a mounting recess assists in firm seating of the saddle members on the support cylinder. The abutment of the side walls and edges of the saddle members with the mounting recess walls, and/or with abutting edges of adjacent saddle members within the same recess, contributes towards firm and secure seating of the saddle member on the cylinder.

Obviously, more than one mounting stud and more than one complementary set of locking members may be employed on each saddle member-mounting recess combination.

Figure 5:
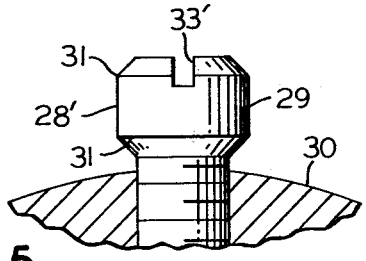
FIG. 5 is a view corresponding to FIG. 4 showing a different embodiment of the mounting stud.

Further, various shaped mounting heads and correspondingly arranged and configured locking members may be employed. For example, FIG. 5 shows in enlarged view another embodiment of a mounting head 28' which is not spherical in shape, but is of somewhat barrel-shaped configuration having a longitudinally extending center portion 29 and rounded shoulder portions 31 over which locking members 48 may readily pass to provide the lock-mounting and de-mounting action. Mounting head 28' has a slot 33' formed therein to receive a slot ended tool for threading the mounting stud into the support cylinder and adjusting it therein as desired. Shoulders 31 are rounded sufficiently to permit locking members 48 to pass thereover without being snagged by shoulders 31.

While the invention has been described in detail with respect to a preferred embodiment thereof, it will be apparent the numerous changes and modifications can be made thereto which are nonetheless within the scope and spirit of the invention and are intended to be encompassed within the scope of the claims appended hereto.

Having thus described the invention, what is claimed is:

1. A press cylinder assembly comprising:

(a) a support cylinder having at least one circumferentially extending mounting recess formed therein to define a recessed mounting surface and circumferentially extending sidewalls;

(b) at least one arcuate saddle member having an inside surface and arcuate sidewalls and being removably mounted on said support cylinder within said one mounting recess with its sidewalls adjacent said circumferential sidewalls of the mounting recess;

(c) at least one mounting stud and at least one locking recess, one of which is situated on said mounting surface of said support cylinder, and the other of which is situated on said inside surface of said one saddle member, said one mounting stud being affixed at one end to the member providing the surface on which it is situated and having a mounting head on its other end and a neck portion of lesser width than the width of said mounting head, said neck portion being formed between said mounting head and said one end, and said one locking recess extending into the member providing the surface on which it is situated; and (d) a plurality of resiliently deflectable locking members mounted on said member providing the surface on which said one locking recess is situated and extending in spaced relationship within said one locking recess, said one stud projecting into said one locking recess with said mounting head disposed in said one locking recess inwardly of and between said locking members, said locking members being spaced apart a distance less than the width of said mounting head and being aligned with said neck portion on opposite sides thereof to resiliently lock said one mounting stud therebetween and thereby maintain said one saddle member on said support cylinder.

2. The assembly of claim 1 wherein said locking members comprise at least a pair of steel wires.

3. The assembly of claim 1 wherein said one mounting recess has a convex floor surface and said inside surface of said one saddle member is concave and congruent to said floor surface.

4. The assembly of claim 1 including a plurality of said circumferentially extending mounting recesses, a plurality of said mounting studs, and a plurality of said saddle members.

5. The assembly of claim 1 wherein said at least one circumferentially extending recess extends about the entire circumference of said support cylinder so that said one recess comprises a longitudinally extending reduced diameter cylindrical segment of said support cylinder.

6. The assembly of claim 1 wherein said one circumferentially extending mounting recess extends about only a portion of the circumference of said support cylinder whereby it defines end walls as well as said circumferentially extending side walls.

7. The assembly of claim 1 wherein said one mounting stud is situated on said mounting surface, said one mounting stud being affixed at its said one end to said support cylinder in said one recess, and said one locking recess is situated on said inside surface of said one saddle member, said locking members being mounted on said one saddle member.

8. The assembly of claim 7 including a plurality of said mounting recesses, a plurality of said mounting studs and a plurality of said saddle members, said mounting recesses having convex floor surfaces and said saddle members having concave inside surfaces which are congruent to their associated mounting floor surfaces.

9. The assembly of claim 1 wherein said one mounting stud is situated on said inside surface of said one saddle member, said one mounting stud being affixed at its said one end to said one saddle member, and said one locking recess is situated in said mounting floor of said one mounting recess, said locking members being mounted on said support cylinder.

10. The assembly of claim 9 including a plurality of said mounting recesses, a plurality of said mounting studs and a plurality of said saddle members, said mounting recesses having convex floor surfaces and said saddle members having concave inside surfaces which are congruent to their associated mounting floor surfaces.

11. A press cylinder comprising:

(a) a support cylinder having an outer surface and at least one circumferentially extending mounting recess formed therein, said recess having circumferentially extending side walls and a convex floor surface;

(b) at least one mounting stud including a shaft affixed at one end to said support cylinder, a mounting head at its other end and a neck portion formed between said mounting head and said shaft, said neck portion being of lesser width than said mounting head, said mounting head and said neck portion projecting outwardly of said convex floor surface;

(c) at least one arcuate saddle member received within said one recess, said one saddle member having a concave inside surface which is substantially congruent to and seated upon said convex floor surface, and further having arcuate side walls abutting said circumferentially extending side walls and an outside surface on which marking means is supported, said one saddle member further including a locking recess formed in said inner surface thereof;

(d) a plurality of resiliently deflectable locking members mounted on said one saddle member and extending in spaced relationship within said locking recess, said locking members being spaced apart a distance less than the width of said mounting head, said one mounting stud projecting into said locking recess with said mounting head disposed within said locking recess inwardly thereof with said neck portion being disposed between and aligned with said locking members whereby said locking members resiliently lock said mounting stud therebetween to thereby maintain said saddle member on said support cylinder.

12. The assembly of claim 11 including a plurality of said mounting recesses, a plurality of said mounting studs and a plurality of said saddle members.

13. The assembly of claim 12 wherein said locking members comprise a pair of spaced apart steel wires.

14. The assembly of claim 12 wherein said marking means comprises printing type formed on a flexible printing plate supported on said outside surface.

15. A press cylinder assembly comprising:

(a) a support cylinder having an outer surface and at least one circumferentially extending mounting recess formed therein, said recess having circumferentially extending side walls and a convex floor surface, and a locking recess formed in said floor surface of said mounting recess;

(b) at least one arcuate saddle member received within said mounting recess, said one saddle member having a concaved inside surface which is substantially congruent to and seated upon said convex floor surface, and further having arcuate side walls abutting said circumferentially extending side walls and an outside surface on which marking means is supported;

(c) at least one mounting stud including a shaft affixed at one end to said one saddle member, a mounting head at its other end and a neck portion formed between said mounting head and said shaft, said nec portion being of lesser width than said mounting head, said mounting head and said neck portion projecting outwardly of said inside surface of said one saddle member;

(d) a plurality of resiliently deflectable locking members mounted on said support cylinder and extending in spaced relationship within said locking recess, said locking members being spaced apart a distance less than the width of said mounting head, said one mounting stud projecting into said locking recess with said mounting head disposed between and aligned with said locking members whereby said locking members resiliently lock said one mounting stud therebetween to thereby maintain said one saddle member on said support cylinder.

16. The assembly of claim 15 including a plurality of said mounting recesses, a plurality of said mounting studs and a plurality of said saddle members.

17. The assembly of claim 16 wherein said locking members comprise a pair of spaced apart steel wires.

18. The assembly of claim 16 wherein said marking means comprise printing type formed on a flexible printing plate supported on said outside surface.

* * * * *